US010138752B2

(12) United States Patent
Schilling

(10) Patent No.: US 10,138,752 B2
(45) Date of Patent: Nov. 27, 2018

(54) ACTIVE HPC CLEARANCE CONTROL

(71) Applicant: General Electric Company, Schenectady, NY (US)

(72) Inventor: Jan Christopher Schilling, Liberty Township, OH (US)

(73) Assignee: General Electric Company, Schenectady, NY (US)

( * ) Notice: Subject to any disclaimer, the term of this patent is extended or adjusted under 35 U.S.C. 154(b) by 216 days.

(21) Appl. No.: 15/053,276

(22) Filed: Feb. 25, 2016

(65) Prior Publication Data

US 2017/0248028 A1 Aug. 31, 2017

(51) Int. Cl.
*F02C 6/08* (2006.01)
*F01D 11/24* (2006.01)

(52) U.S. Cl.
CPC ..... *F01D 11/24* (2013.01)

(58) Field of Classification Search
CPC ..... F01D 11/24
See application file for complete search history.

(56) References Cited

U.S. PATENT DOCUMENTS 4,023,919 A * 5/1977 Patterson ..... F01D 11/18 415/134
4,280,792 A * 7/1981 Hartel ..... F01D 11/08 165/169
4,426,191 A * 1/1984 Brodell ..... F01D 25/246 415/189
4,512,712 A * 4/1985 Baran, Jr. ..... F01D 25/246 411/337
4,550,562 A * 11/1985 Rice, IV ..... F01K 23/10 60/728

(Continued)

FOREIGN PATENT DOCUMENTS

EP 1 475 515 A2 11/2004
GB 2 078 859 A 1/1982

OTHER PUBLICATIONS

Extended European Search Report and Opinion issued in connection with corresponding EP Application No. 7157936.0 dated Jul. 6, 2017.

*Primary Examiner* — Jesse Bogue
(74) *Attorney, Agent, or Firm* — General Electric Company; Brian Overbeck

(57) ABSTRACT

A gas turbine engine clearance control system includes a cooling air passage extending from a cooling air inlet port to a cooling air outlet port. The cooling air inlet port and outlet port are formed within an external surface of a compressor casing of a compressor and are also axially spaced on the external surface of the compressor casing. The cooling air passage extends from the cooling air inlet port radially inwardly to at least one of a flange joint, a radially outer surface of a compressor casing ring, and a radially outer surface of a connector case. The cooling air passage further extends aftward along the radially outer surfaces of the connector case and the compressor casing ring. The cooling air passage further extends radially outward to the cooling air outlet port. Selectively supplying cooling air to the cooling air passage controls a rotor tip clearance between a rotor tip of a rotor blade of the compressor and an inner surface of the compressor casing ring and further controls an interstage seal clearance between an inner band and a rotor spool of the compressor.

17 Claims, 7 Drawing Sheets

(56) References Cited

U.S. PATENT DOCUMENTS

| | | | | | |
|---|---|---|---|---|---|
| 4,841,726 | A | | 6/1989 | Burkhardt | |
| 4,893,984 | A | | 1/1990 | Davisonh et al. | |
| 5,048,288 | A | | 9/1991 | Bessette et al. | |
| 5,167,488 | A | * | 12/1992 | Ciokajlo | F01D 11/005 415/139 |
| 5,297,386 | A | | 3/1994 | Kervistin | |
| 5,605,437 | A | * | 2/1997 | Meylan | F01D 11/24 415/1 |
| 5,685,158 | A | | 11/1997 | Lenahan et al. | |
| 5,685,693 | A | * | 11/1997 | Sexton | F01D 11/24 415/173.1 |
| 5,899,660 | A | * | 5/1999 | Dodd | F01D 9/041 415/108 |
| 6,126,390 | A | * | 10/2000 | Bock | F01D 11/18 415/115 |
| 6,732,530 | B2 | | 5/2004 | Laurello et al. | |
| 6,925,814 | B2 | | 8/2005 | Wilson et al. | |
| 7,165,937 | B2 | | 1/2007 | Dong et al. | |
| 7,434,402 | B2 | * | 10/2008 | Paprotna | F01D 11/24 415/115 |
| 8,181,443 | B2 | | 5/2012 | Rago | |
| 2002/0005038 | A1 | * | 1/2002 | Boeck | B64D 33/08 60/204 |
| 2005/0031446 | A1 | | 2/2005 | Ress, Jr. et al. | |
| 2006/0225430 | A1 | | 10/2006 | Paprotna et al. | |
| 2013/0177414 | A1 | | 7/2013 | Bonneau et al. | |

* cited by examiner

ACTIVE HPC CLEARANCE CONTROL

BACKGROUND

The field of the disclosure relates generally to gas turbine engines and, more particularly, to a method and system for controlling compressor clearance at various stages of flight using active cooling of the compressor case.

Gas turbine engines typically include multiple compressor stages to compress incoming air flow for delivery to the combustor. The rotor blades and compressor casing are subjected to a range of temperatures during various stages of operation such as ground operation, takeoff, and cruise, resulting in thermal expansion or contraction of these compressor components. Typically, the components of the compressor stages are designed to operate with minimal rotor tip clearances and interstage seal clearances to enhance thrust production during takeoff. However, during cruise conditions, operating temperatures of the compressor stages are lower than at takeoff, resulting in higher clearances due to thermal contraction of the compressor components. Higher rotor tip and interstage seal clearances degrade the efficiency of operation of the gas turbine engine at cruise conditions. A reduction in rotor tip and interstage seal clearances at cruise conditions, without impacting the operation of the gas turbine engine at takeoff conditions, can enhance fuel efficiency of the gas turbine engine during cruise conditions with minimal impact on thrust production at takeoff conditions.

BRIEF DESCRIPTION

In one embodiment, a gas turbine engine clearance control system includes a cooling air passage extending from a cooling air inlet port to a cooling air outlet port. The cooling air inlet port and outlet port are formed within an external surface of a compressor casing of a compressor and are axially spaced on this external surface. The cooling air passage extends from the cooling air inlet port radially inwardly to at least one of a flange joint, a radially outer surface of a compressor casing ring, and a radially outer surface of a connector case. The cooling air passage further extends aftward along the radially outer surfaces of the connector case and the compressor casing ring. The cooling air passage further extends radially outward to the cooling air outlet port. Selectively supplying cooling air to the cooling air passage controls a rotor tip clearance between a rotor tip of a rotor blade of the compressor and an inner surface of the compressor casing ring and further controls an interstage seal clearance between an inner band and a rotor spool of the compressor. The rotor blade extends radially outwardly from an inner flow path surface of a rotor blade platform attached to the rotor spool towards an inner surface of the compressor casing ring and terminates at the rotor tip proximate the inner surface. Each of a plurality of stator vanes extends radially inwardly from a radially inner surface of an outer band and terminates at an inner band. The outer band is configured to couple to the compressor casing ring radially with axial contact to adjacent outer band. The flange joint is configured to couple the compressor casing ring and the connector case. The compressor casing ring includes a radially outwardly extending flange portion configured to be coupled to radially outwardly extending mounting flanges of the connector case axially adjacent to the flange portion.

In another embodiment, a method of selectively cooling a compressor of a gas turbine engine includes receiving a flow of cooling air from one of a plurality of selectable sources of cooling air, and channeling the flow of cooling air along a cooling air passage within a compressor casing of the compressor. The cooling air passage is adjacent to at least one of a flange joint, a radially outer surface of a connector case, and a radially outer surface of a compressor casing ring.

In an additional embodiment, a gas turbine engine includes a compressor that includes a compressor casing. The compressor casing includes at least one connector case coupled to at least one axially adjacent compressor casing ring. The gas turbine engine further includes a gas turbine engine clearance control system configured to selectively cool the compressor casing. The gas turbine engine clearance control system includes at least one source of cooling air operatively coupled to at least one valve to provide cooling air from one of at the least one sources. The at least one valve is operatively coupled to a cooling air inlet port of a cooling air passage formed within an external surface of the compressor casing. The cooling air passage extends from the cooling air inlet port through a path adjacent at least one of a flange joint, a radially outer surface of the compressor casing ring, and a radially outer surface of the connector case and further extends to a cooling air outlet port formed in the external surface of the compressor casing. Cooling air from one of the at least one sources is directed through the air passage when one of the at least one valves is opened, thereby cooling the compressor casing.

In another additional embodiment, a gas turbine engine clearance control system includes a cooling air passage extending from a cooling air inlet port to a cooling air outlet port. The cooling air inlet port and outlet port are formed within an external surface of a compressor casing of a compressor and are also axially spaced on the external surface of the compressor casing. The cooling air passage extends from the cooling air inlet port radially inwardly to at least one of a flange joint, a radially outer surface of a compressor casing ring, and a radially outer surface of a connector case. The cooling air passage further extends aftward along the radially outer surfaces of the connector case and the compressor casing ring. The cooling air passage further extends radially outward to the cooling air outlet port. Selectively supplying cooling air to the cooling air passage controls a rotor tip clearance between a rotor tip of a rotor blade of the compressor and an inner surface of the compressor casing ring and further controls an interstage seal clearance between an inner band and a rotor spool of the compressor.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein:

FIG. 1 is a schematic illustration of a gas turbine engine;

FIG. 2 is a cross-sectional illustration of several compressor stages of a compressor of a gas turbine engine;

FIG. 3 is a schematic diagram of a gas turbine engine clearance control system for a gas turbine engine;

FIG. 4 is a cross-sectional view of a compressor and a gas turbine engine clearance control system;

FIG. 5 is a cross-sectional view of a clearance of a rotor blade tip relative to a radially inner surface of a compressor casing ring within a compressor;

FIG. 6 is a cross-sectional view of an interstage seal assembly of a compressor; and FIG. 7 is a cross-sectional view of a vane assembly without an interstage seal but having a clearance of a vane assembly relative to a rotor spool within a compressor.

Figure 1:
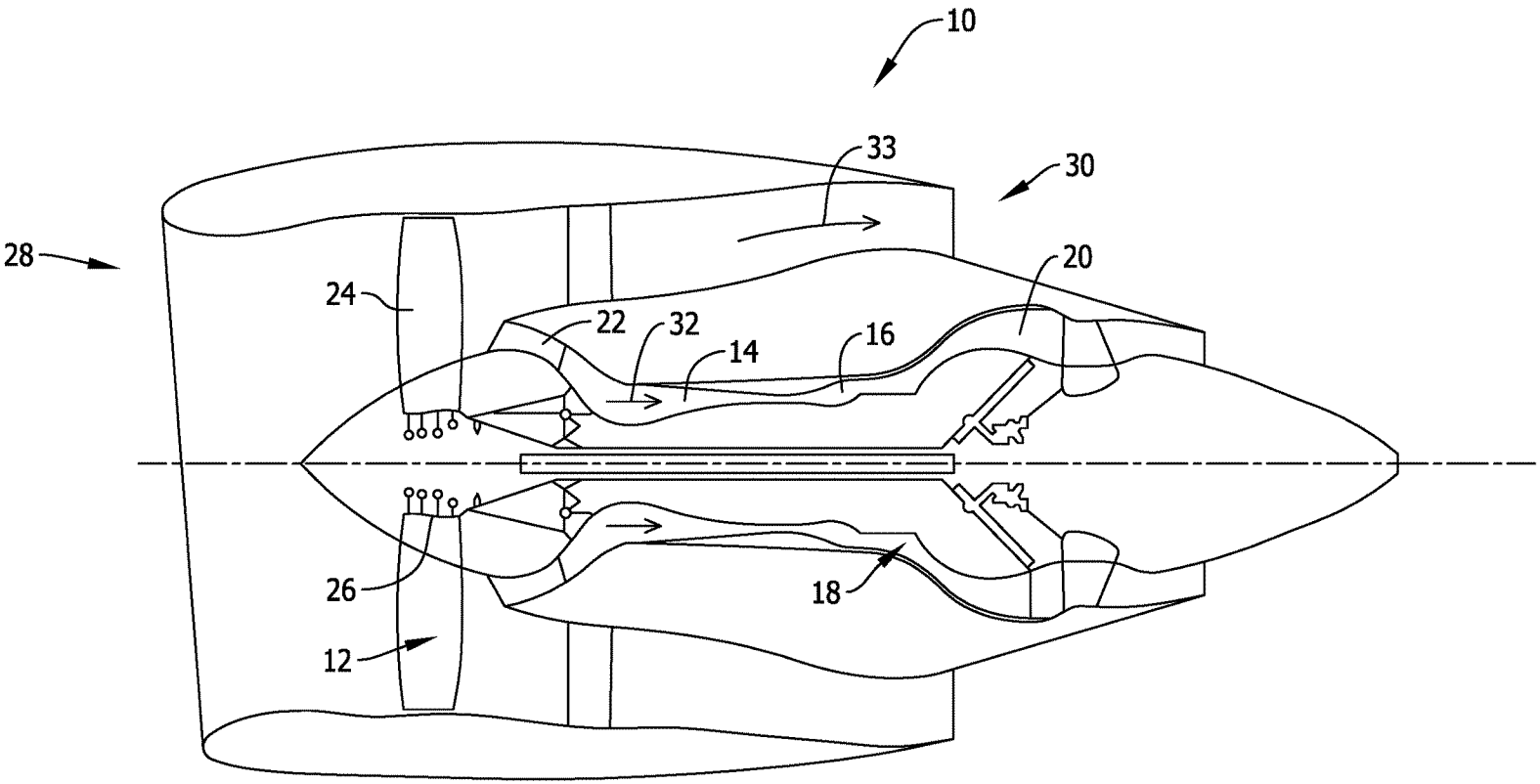
FIGS. 1, 2, 3, 4, 5, 6, and 7 show example embodiments of the system and method described herein.

Although specific features of various embodiments may be shown in some drawings and not in others, this is for convenience only. Any feature of any drawing may be referenced and/or claimed in combination with any feature of any other drawing.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise.

The following detailed description illustrates embodiments of the disclosure by way of example and not by way of limitation. It is contemplated that the disclosure has general application to a method and system for cooling a stationary member of a body that includes the stationary member as well as a rotating member that rotates about a rotation axis within a duct formed within the stationary member. In one exemplary embodiment, the body is a gas turbine engine, the stationary member is a compressor casing of compressor of the gas turbine engine, and the rotating member is a rotor that rotates about the rotation axis within a duct formed within the compressor casing. Although various embodiments of the gas turbine engine clearance control system and methods of cooling a stationary member of a body are described in terms of this exemplary embodiment, it is to be understood that the gas turbine engine clearance control system and methods are suitable for cooling the stationary member of any body as defined herein without limitation.

Embodiments of the gas turbine engine clearance control system described herein direct cooling air through a cooling air passage formed within at least one compressor casing of a compressor of a gas turbine engine. The gas turbine engine clearance control system includes at least one source of cooling air operatively coupled to at least one corresponding valve to selectively provide cooling air from one of said at least one sources to the cooling air passage formed within the compressor casing. The gas turbine engine clearance control system described herein is configured to direct cooling air through the cooling air passage of the compressor casing, thereby selectively cooling the compressor casing when one valve of the at least one corresponding valves is opened. Selectively cooling the compressor casing enables the control of at least two clearances between adjacent elements of the compressor: a rotor tip clearance between a rotor tip of a rotor blade and an inner surface of an adjacent compressor casing ring, and an interstage seal clearance between an inner band of a vane assembly and a rotor spool of the compressor.

The gas turbine engine clearance control system described herein offers advantages over known methods of cooling components of the compressor of a gas turbine engine. More specifically, the gas turbine engine clearance control system enables the selective cooling of the compressor case when the gas turbine engine is operating at cruise conditions. In use, the gas turbine engine clearance control system may be disabled when the gas turbine engine operates under several conditions including, but not limited to ground taxiing, takeoff, and surge conditions, thereby enabling the compressor casing to expand to accommodate thermal and elastic lengthening of the rotor blades as well as growth of the rotor spool/disc of the compressor, resulting in a compressor clearance suitable for operation at the most limiting clearance condition. When the gas turbine engine is operating at cruise conditions, the gas turbine engine clearance control system may be activated to selectively cool the compressor casing, causing the compressor casing to contract. The contraction of the compressor casing reduces the compressor rotor blade tip clearances and the interstage seal clearances, or the vane tip clearance relative to the rotor spool for compressor designs lacking an interstage seal, thereby enhancing the efficiency of operating the gas turbine engine and reducing overall fuel usage by the gas turbine engine.

FIG. 1 is a schematic illustration of a gas turbine engine 10 including a fan assembly 12, a high pressure compressor 14, and a combustor 16. Engine 10 also includes a high pressure turbine 18, a low pressure turbine 20, and a booster 22. Fan assembly 12 includes an array of fan blades 24 extending radially outward from a rotor disc 26. Engine 10 has an intake side 28 and an exhaust side 30.

In operation, air flows through fan assembly 12 and compressed air is supplied to high pressure compressor 14. Highly compressed air is delivered to combustor 16. Air flow 32 from combustor 16 drives turbines 18 and 20, and turbine 20 drives fan assembly 12. In various embodiments, compressor 14 may include one or more compressor stages (not illustrated).

Figure 2:
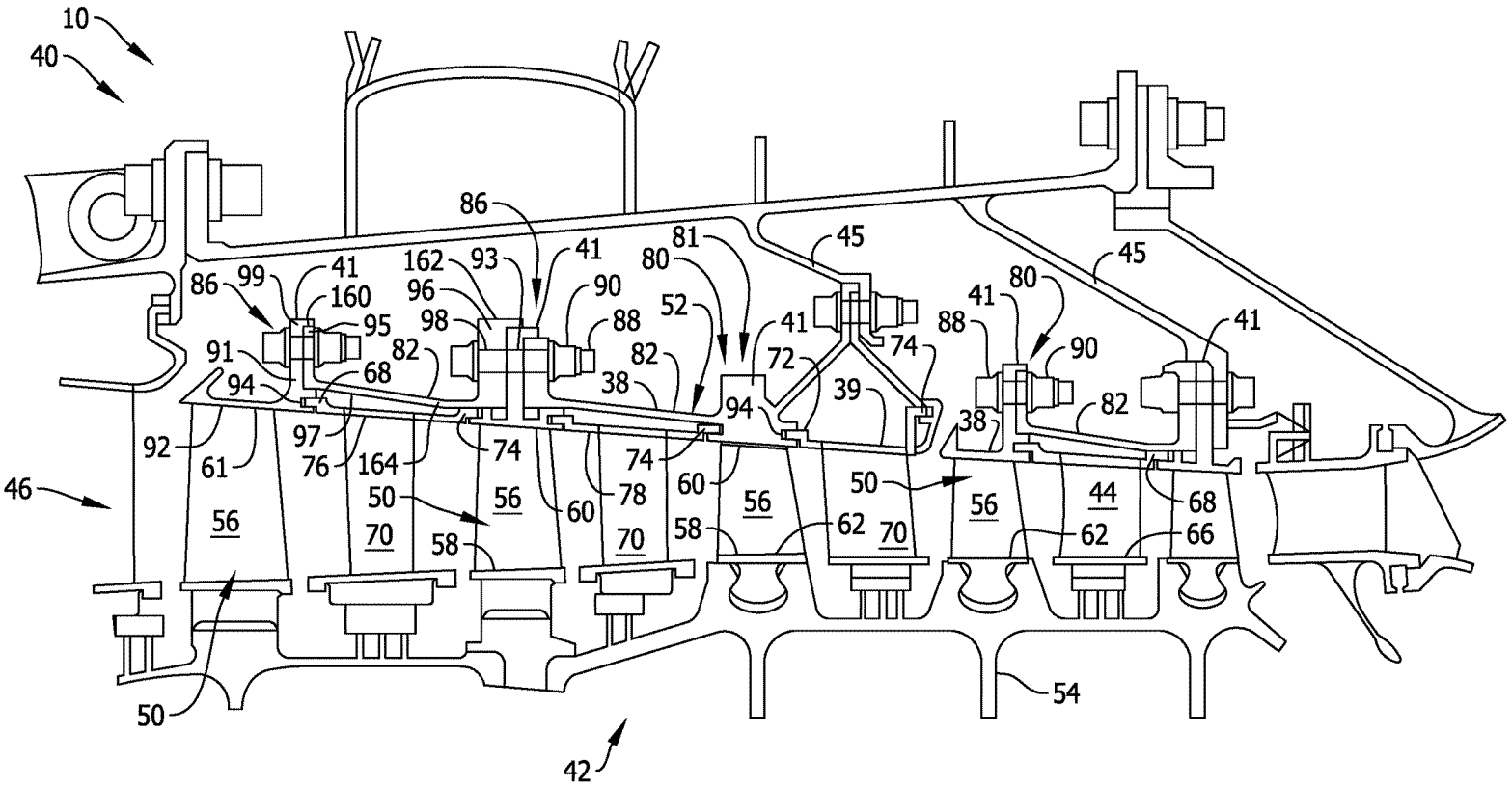

FIG. 2 is a cross-sectional illustration of a portion of a compressor 40 of gas turbine engine 10. In the exemplary embodiment illustrated in FIG. 2, compressor 40 is a high pressure compressor. Compressor 40 includes a plurality of rotor assemblies 42, a plurality of stator vane assemblies 44, and a compressor casing 80 that are coupled together to define a flow path 46 through compressor 40. Specifically, compressor 40 includes a plurality of stages, and each stage includes a rotor assembly 42 and a stator vane assembly 44. Each stator vane assembly 44 is interdigitated between adjacent rows of rotor blades 50. In this arrangement, compressor flow path 46 includes a plurality of interdigitated stator vanes 70 and rotor blades 50. The compressor stages are configured for cooperating with a motive or working fluid, such as air, such that the motive fluid is compressed in succeeding stages.

Figure 5:
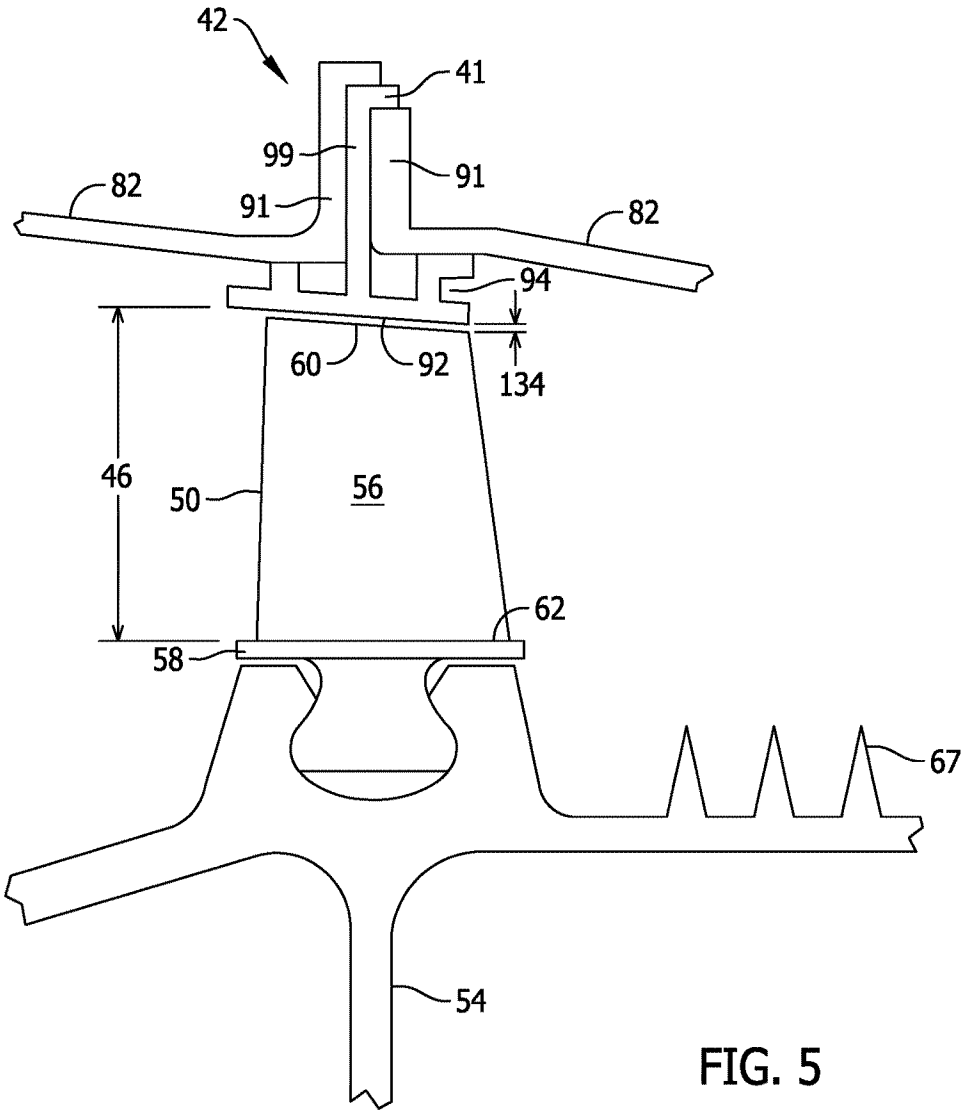

In the exemplary embodiment, each rotor assembly 42 includes a plurality of rotor blades 50, one of which is illustrated in FIG. 5. More specifically, each rotor blade 50 extends radially outwardly from rotor spool 54 between a rotor blade platform 58 and a rotor tip 60. Each rotor tip 60 of each rotor blade 50 terminates just inward of radially inner surface 92 of compressor casing ring 41, resulting in a rotor tip clearance 134, defined herein as a separation distance between rotor tip 60 and radially inner surface 92 of an adjacent compressor casing ring 41.

Figure 6:
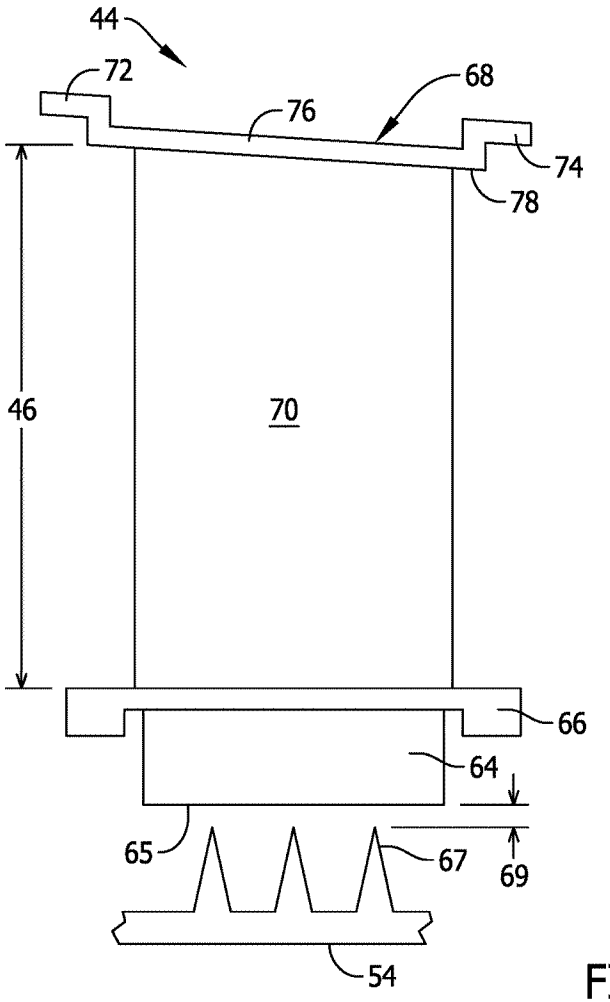

Referring to FIGS. 2 and 6, each stator vane assembly 44 includes inner band 66, outer band 68, and stator vane 70. Stator vane 70 extends radially inward from a radially inner surface 78 of outer band 68 to inner band 66. Each outer band 68 includes an upstream mounting flange 72, a downstream mounting flange 74, and a band body 76 extending therebetween. Outer band mounting flanges 72 and 74 couple to corresponding hook assemblies 94 on adjacent compressor casing rings 41 of compressor casing 80, as illustrated in FIG. 2. Radially inner surfaces 78 of outer bands 68 (see FIG. 6), along with corresponding radially inner surfaces 92 of compressor casing rings 41 (see FIG. 5), form a duct wall 61 circumscribing flow path 46 as the motive fluid is compressed from stage to stage. Inner bands 66 of stator vane assemblies 44 (see FIG. 6) and inner flow path surfaces 62 of blade platforms 58 (see FIG. 5) together define at least a portion of a radially inner surface directing flow path 46 as motive fluid is compressed from stage to stage.

Figure 7:
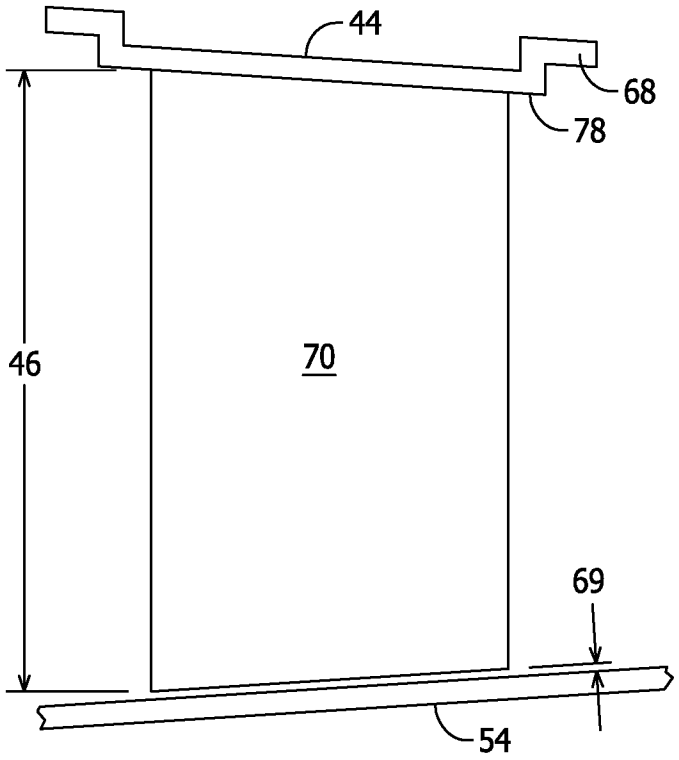

Referring to FIG. 7, in another embodiment each stator vane assembly 44 includes outer band 68 and stator vane 70, but may not include interstage seal assembly 64 illustrated in FIG. 6. In this embodiment, stator vane 70 extends radially inward from a radially inner surface 78 of outer band 68 and terminates adjacent to rotor spool 54, forming interstage clearance 69 between stator vane 70 and rotor spool 69. In this embodiment, interstage clearance 69 is defined as a separation distance between stator 70 and rotor spool 54.

Referring again to FIG. 2, compressor casing 80 includes a plurality of compressor casing rings 41 and connector cases 82 coupled together by a plurality of flange joints 86. In the exemplary embodiment, each flange joint 86 includes a threaded bolt 88 and a nut 90 that couple together to form a controlling mass that secures adjacent compressor casing rings 41 and connector cases 82 together. Also shown in FIG. 2 is a casing ring assembly 81 without attached flange joints but also forming a controlling mass.

Referring again to FIG. 2 and FIG. 5, connector cases 82 are annular and extend axially between adjacent compressor casing rings 41. Each connector case 82 includes an upstream mounting flange 95, a downstream mounting flange 96, and a solid connector body 97 extending therebetween. Each mounting flange 95 and 96 includes a plurality of circumferentially-spaced openings 98 that are sized to receive fastener assembly bolts 88 therethrough. Openings 98 are aligned with corresponding circumferentially-spaced openings 93 formed within flange portion 99 of compressor casing ring 41. Bolts 88 are inserted through aligned openings 93 and 98 and secured with nuts 90 to form flange joints 86 coupling adjacent compressor casing rings 41 and connector cases 82 together.

Referring again to FIG. 5, radially inner surface 92 of compressor casing ring 41 is oriented at an angle with respect to flange portion 99 of compressor casing ring 41 to enable air compression within flow path 46, and the separation between radially inner surface 92 of compressor casing ring 41 and rotor tip 60 is referred to as a rotor tip clearance 134. In the exemplary embodiment, compressor casing ring 41 is formed with at least one hook assembly 94 for coupling each compressor casing ring 41 to a corresponding upstream mounting flange 72 or downstream mounting flange 74 of an outer band 68 of a respective stator vane assembly 44 (see FIG. 2 and FIG. 6). Accordingly, each hook assembly 94 is sized to receive corresponding outer band mounting flanges 72 or 74 therein.

Referring to FIG. 6, interstage seal assembly 64 is attached to inner band 66 of stator vane assembly 44 in one embodiment, forming an abradable inner surface 65 adjacent to rotor spool teeth 67. Inner surface 65 and rotor spool teeth 67 projecting radially inward from rotor spool 54 form an interstage seal between consecutive compressor stages. As rotor spool teeth 67 rub inner surface 65 during engine operation, abrasion of inner surface 65 forms an interstage clearance 69, defined herein as a separation distance between inner surface 65 and adjacent rotor spool teeth 67 of rotor spool 54.

Referring again to FIG. 2, compressor 40 of gas turbine engine clearance control system 100 further includes an outer support structure 45 of compressor casing 80 circumscribing compressor casing rings 41 and stator vane assemblies 44. In various embodiments, one or more connector cases 82, compressor casing rings 41, and/or flange joints 86 are coupled with one or more elements of outer support structure 45 of compressor casing 80. When compressor 40 is assembled, each stator vane assembly 44 is coupled to adjacent compressor casing rings 41 such that a duct wall 61 circumscribing flow path 46 is defined by radially inner surfaces 92 of compressor casing rings 41 and radially inner surfaces 78 of outer bands 68 as motive fluid is compressed from stage to stage. In addition, a radially inner flow path boundary of flow path 46 is defined by inner bands 66 of stator vane assemblies 44 (see FIG. 6) and inner flow path surfaces 62 of blade platforms 58 (see FIG. 5) of assembled compressor 40. Furthermore, when compressor 40 is assembled, each connector casing 82 is positioned radially outwardly from outer band 68 of each respective stator vane assembly 44.

Figure 3:
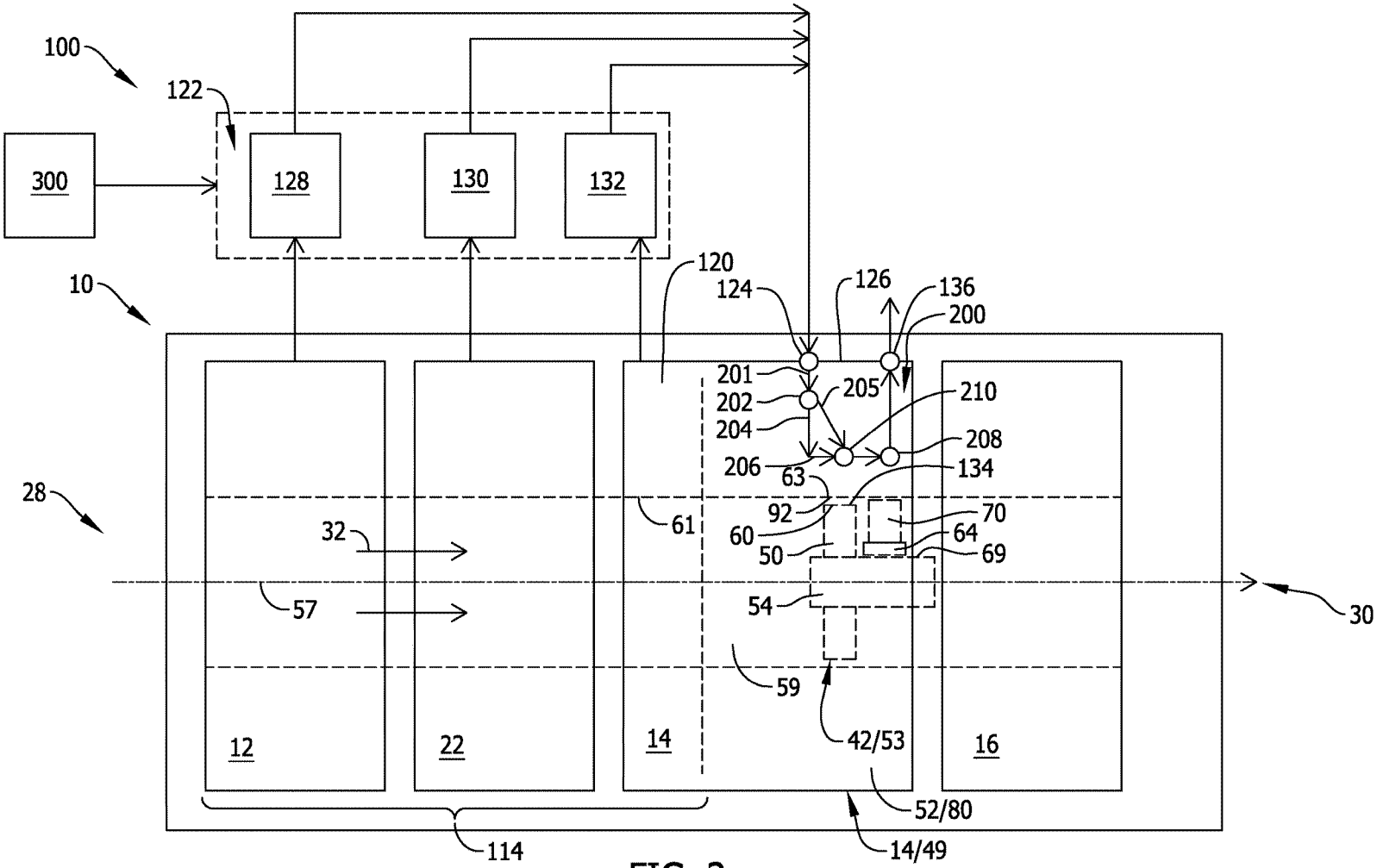

FIG. 3 is a schematic illustration of a gas turbine engine clearance control system 100 in an exemplary embodiment. In this exemplary embodiment, gas turbine engine clearance control system 100 is configured to cool stationary member 52 of body 49 that further includes rotating member 53. Rotating member 53 rotates about rotation axis 57 within a duct 59 formed through stationary member 52. In the exemplary embodiment illustrated in FIG. 3, body 49 is compressor 14 of gas turbine engine 10, stationary member 52 is a compressor casing 80 circumscribing a duct 59, and rotating member 53 is a rotor assembly 42 of compressor 14 that includes a rotor spool 54 and a rotor blade 50.

Gas turbine engine clearance control system 100 includes at least one source of cooling air 114. Any source of air characterized by a temperature that is cooler than compressor casing 80 may be used as a source of cooling air 114 without limitation. In some embodiments, the source of cooling air 114 is bleed air from one of the engine elements situated between compressor casing 80 and intake side 28 of gas turbine engine 10. Without being limited to any particular theory, engine elements situated closer to combustor 16 near exhaust side 30 typically contain air flow 32 that is warmer compared to engine elements situated closer to intake side 28. Non-limiting examples of suitable sources of cooling air 114 include fan cooling air from fan assembly 12, booster air from booster 22, engine domestic bleed from an upstream compressor stage 120, and any combination thereof.

Each cooling air source 114 is operatively coupled to a corresponding valve 122. In addition, each valve 122 is operatively coupled to a respective cooling air inlet port 124 formed in an external surface 126 of compressor casing 80. In various aspects, each cooling air source 114 is operatively coupled to a single valve 122 to enable the selection of a single cooling air source 114 for cooling compressor casing 80, as discussed in additional detail herein below. As illustrated in FIG. 3, in the exemplary embodiment, fan assembly 12 is operatively coupled to a first valve 128, booster 22 is operatively coupled to a second valve 130 and upstream compressor stage 120 is operatively coupled to a third valve 132.

In one embodiment, one or more of valves 122 are existing valves associated with other systems and devices of gas turbine engine 10. In this embodiment, existing valve may be modified to operatively couple with cooling air inlet port 124 of compressor casing 80. In use, existing valve is opened to activate gas turbine engine clearance control system 100 as well as to activate other systems and devices of gas turbine engine 10 associated with existing valve. Non-limiting examples of other systems and devices associated with existing valve include cooling of other elements of gas turbine engine 10 such as turbine blades or gear boxes.

Gas turbine engine clearance control system 100 further includes a cooling air passage 200 to direct cooling air from one source of cooling air 114 through compressor casing 80 when one of valves 122 is opened, thereby selectively cooling compressor casing 80. As used herein, "selectively cooling" compressor casing 80 refers to cooling only compressor casing 80, in particular those portions of compressor casing 80 defining duct 59 through compressor casing 80. Selectively cooling compressor casing 80 causes thermal contraction of compressor casing 80 and associated reduction in diameter of duct 59 within compressor casing 80.

Without being limited to any particular theory, during certain stages of operation of gas turbine engine 10 including, but not limited to, cruising at altitude, air flow 32 entering intake side 28 is the working fluid which when compressed increases the temperature and pressure inside duct 59, causing thermal expansion of elements of compressor elements. Because compressor casing 80 is subject to heating by at least one heat source including, but not limited to, heat convection and conduction from air flow 32 through compressor 14 and extraction air (not illustrated) flowing outboard of duct 59, those portions of compressor casing 80 defining duct wall 61 of duct 59 through compressor casing 80 do not thermally expand or contract to the same degree as rotor blade 50 and/or rotor spool 54. Consequently, in the absence of additional cooling by gas turbine engine clearance control system 100, rotor tip clearance 134, defined herein as separation of rotor tip 60 from radially inner surface 92 of compressor casing ring 41 (see FIG. 5), is increased. In addition, the interstage clearance 69 between the rotor spool 54 and adjacent interstage seal assembly 64 attached to stator vane 70 (see FIG. 6) increases in the absence of additional cooling by gas turbine engine clearance control system 100. Without being limited to any particular theory, increased rotor tip clearance 134 and increased interstage clearance 69 are associated with a reduction in engine efficiency. Cooling compressor casing 80 using gas turbine engine clearance control system 100 causes thermal contraction of the compressor elements forming duct wall 61. As a result, the diameter of duct 59 is reduced, causing a reduction in rotor tip clearance 134 and interstage clearance 69 of compressor 14.

In this exemplary embodiment, illustrated in FIG. 3, cooling air passage 200 directs cooling air from one cooling air source 114 through compressor casing 80 between cooling air inlet port 124 and a cooling air outlet port 136 formed on external surface 126 of compressor casing 80 when one of valves 122 is opened. In particular, cooling air passage 200 directs cooling air toward exterior surface 63 of duct wall 61. Non-limiting elements of compressor 14 making up duct wall 61 include a flange joint 86, a radially outer surface 39 of a compressor casing ring 41 and casing ring assembly 81, or a radially outer surface 38 of a connector case 82 (see FIG. 2). The cooling of outer surfaces 38 and 39 enables thermal contraction of duct wall 61, as well as an associated reduction in diameter of duct 59 and reduction in rotor tip clearance 134 and interstage clearance 69. In various embodiments, cooling air passage 200 generally directs cooling air from cooling air inlet port 124 at external surface 126 of compressor casing 80 radially inward toward at least one of flange joint 86, radially outer surface 39 of compressor casing ring 41, and radially outer surface 38 of connector case 82 (see FIG. 2). In addition, cooling air passage 200 generally directs cooling air radially outward toward cooling air outlet port 136 at external surface 126 of compressor casing 80. Cooling air outlet port 136 is axially spaced from cooling air inlet port 124.

In some embodiments, cooling air passage 200 may bifurcate the air flow 201 into at least a first portion 204 and a second portion 205 via at least one bifurcation 202. In this embodiment, first portion 204 and second portion 205 are directed around flange joint 86 (see FIG. 2). First portion 204 is directed radially inward from external surface 126 along flange joint 86 and toward radially outer surface of outer band 68 (see FIG. 2) defining duct wall 61 in a direction essentially perpendicular to rotation axis 57. Second portion 205 is directed aftward in a second direction along exterior surface 63 of duct wall 61. In various embodiments, first portion 204 of cooling air cools regions of compressor casing 80 such as compressor casing ring 41 that include radially inner surface 92 the define rotor tip clearance 134 (see FIG. 5). In various other embodiments, second portion 205 of cooling air directed along exterior surface 63 of duct wall 61 cools regions of compressor casings 80 and outer bands 68 that define interstage clearance 69. The combined cooling of duct wall 61 by first portion 204 and second portion 205 of cooling air reduces rotor tip clearance 134 and interstage clearance 69 as described herein previously.

In some embodiments, cooling air passage 200 may further direct first portion 204 and second portion 205 of cooling air to a cooling air outlet port 136 formed in external surface 126 of compressor casing 80 using a baffle 208 operatively coupled to cooling air passage 200 between bifurcation 202 and cooling air outlet port 136. Cooling air is then directed away from compressor casing 80 to transfer heat from duct wall 61 and other elements of compressor casing 80 via convection by cooling fluid. By way of non-limiting example, cooling fluid leaving cooling air outlet port 136 is vented into bypass air flow 33 (see FIG. 1). In some embodiments, cooling air passage 200 may further include a manifold 210 situated between at least one bifurcation 202 and baffle 208 to rejoin first portion 204 and second portion 205 of cooling air prior to directing the air flow into baffle 208.

Referring again to FIG. 3, gas turbine engine clearance control system 100 further includes a controller 300 to select and open one of valves 122 to activate gas turbine engine clearance control system 100 and enable selective cooling of compressor casing 80 as needed. Controller 300 also closes one of valves 122 to deactivate activate gas turbine engine clearance control system 100 and terminate selective cooling of compressor casing 80 as needed. In one embodiment, controller 300 selects and opens one valve 128, 130, 132 according to a valve opening state evaluated by controller 300. In this embodiment, controller 300 opens one of valves 128, 130, 132 upon determination by controller 300 that a state of gas turbine engine 10 is the valve opening state. In various aspects, valve opening state is at least one possible state in which cooling of compressor casing 80 is advantageous, as described herein previously. Non-limiting examples of suitable valve opening states include gas turbine engine 10 operating at a cruise condition. Cruise condition, as used herein, is defined as an operating environment characterized by relatively low pressure and low temperature air flow 32 entering intake side 28 of gas turbine engine 10 and relatively low thrust requirements sufficient to maintain cruise airspeed and altitude. In various embodiments, when controller 300 determines that the state of gas turbine engine 10 is the valve opening state, controller selects and opens one of valves 122 to activate gas turbine engine clearance control system 100.

In another embodiment, controller 300 closes one of valves 122 according to a valve closing state evaluated by controller 300. In this other embodiment, controller 300 closes one valve 128, 130, 132 upon determination by controller 300 that a state of gas turbine engine 10 is a valve closing state. In various aspects, the valve closing state is at least one possible state in which operation of gas turbine engine 10 without selective cooling of compressor casing 80 is advantageous, as described herein previously. Non-limiting examples of suitable valve closing states include gas turbine engine 10 operating at a ground condition, gas turbine engine 10 operating at a takeoff condition, gas turbine engine 10 operating at a surge condition, controller 300 detecting an error condition, and any combination thereof. Ground condition, as used herein, is defined as an operating environment associated with taxiing and pre-flight holding and is characterized by air flow 32 entering intake side 28 at sea-level temperature and pressure and by relatively low thrust requirements with occasional bursts to facilitate taxiing starts from stopped positions. Takeoff condition, as used herein, is defined as an operating environment associated with taxiing and pre-flight holding and is characterized by air flow 32 entering intake side 28 at sea-level temperature and pressure and by high thrust requirements associated with accelerating to takeoff speed and climb out to cruise altitude and occasional bursts to facilitate taxiing starts from stopped positions. Surge condition, as used herein, is defined as an operating environment associated with commanded thrust surges associated to adjust airspeed in association with flight activities including, but not limited to adjusting airspeed during cruising flight, adjusting angle of descent during approach to landing, and engine run-up after touchdown and landing rollout. In various embodiments, when controller 300 determines that the state of gas turbine engine 10 is the valve closing state, controller closes one of valves 128, 130, 132 to deactivate gas turbine engine clearance control system 100.

Figure 4:
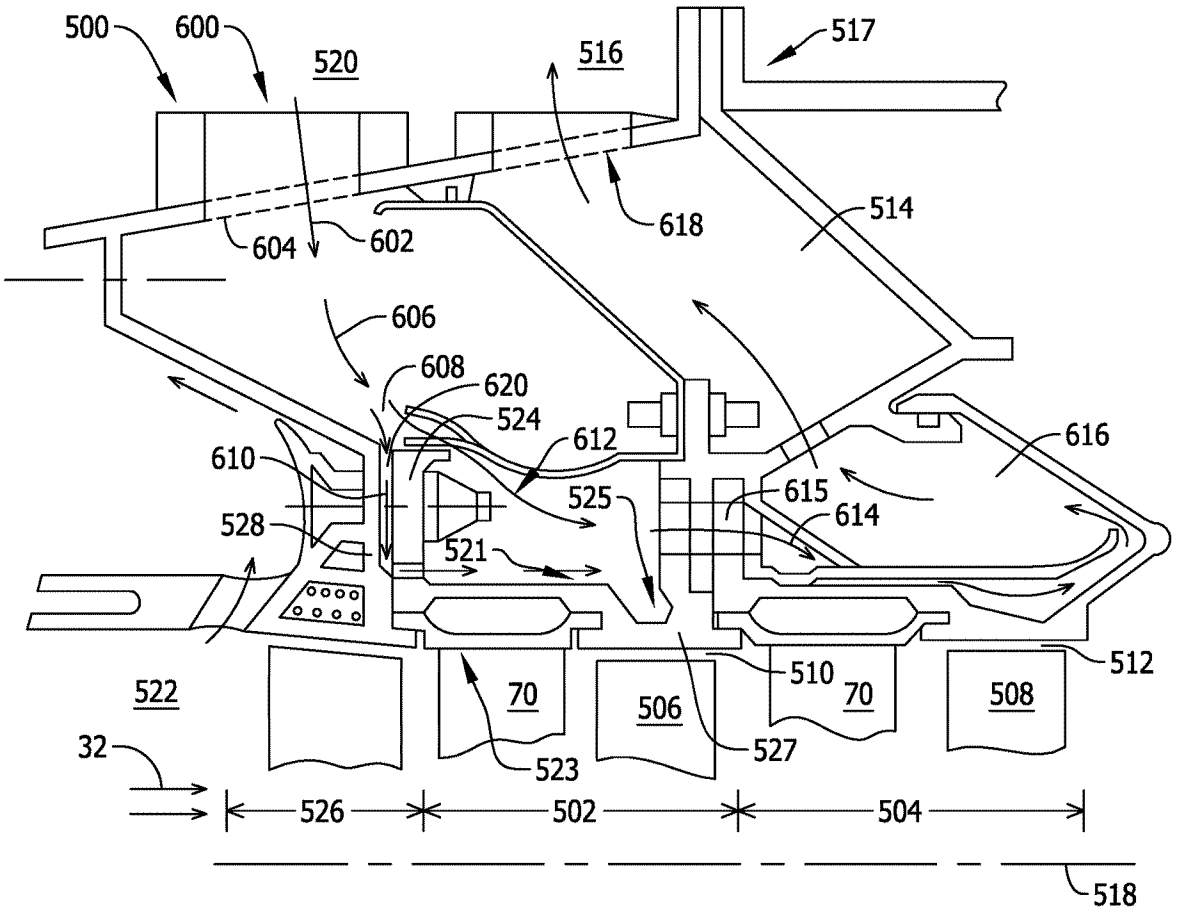

FIG. 4 is a cross-sectional view of a compressor 500 of a gas turbine engine 10 with a gas turbine engine clearance control system 600 in another exemplary embodiment. Compressor 500 includes at least one compressor stage including, but not limited to a first compressor stage 502 and a second compressor stage 504. First compressor stage 502 includes a first rotor 506 and associated first rotor tip clearance 510 and second compressor stage 504 includes a second rotor 508 and associated second rotor tip clearance 512. Compressor 500 further includes an interstage seal (not illustrated) formed between rotor spool 54 and adjacent interstage seal assembly 64 attached to inner tip of stator vane 70 (see FIG. 6).

Gas turbine engine clearance control system 600 is illustrated in FIG. 4 in the activated state with air flow through compressor casing 514. System 100 includes a cooling air inlet port 604 that receives cooling air 602 from a cooling air source (not illustrated). Cooling air 602 is directed downward from an inlet port 520 of outer support structure 517 of compressor casing 514 as incoming air flow 606 to a bifurcation 608, where incoming air flow 606 is split into a first portion 610 travelling in a first direction perpendicular to a rotation axis 518 and a second portion 612 travelling in a second direction essentially along an axial path cooling an external surface 521 of a vane assembly 523 and an external surface 525 of a compressor casing ring 527 defining a portion of a duct 522 formed within compressor casing 514. The first portion 610 of air flow 606 may pass through a gap 620 formed between a first flange 524 and a third flange 528 used to join first compressor stage 502 to third compressor stage 526. The second portion 612 of incoming air flow 606 may pass through one or more passages (not illustrated) formed through one or more structural elements of compressor casing 514 including, but not limited to, flanges, beams, stringers, and any other suitable element of compressor casing 514.

First portion 610 and second portion 612 of incoming air flow 606 enter a manifold 615 that reunites first and second portions 610 and 612 into a single outgoing air flow 614 entering a baffle 616. Baffle 616 redirects outgoing air 614 back toward cooling air exit 618 formed within exit port 516 of outer support structure 517 of compressor casing 514.

Various embodiments of gas turbine engine clearance control systems direct cooling air through multi-stage compressors of gas turbine engines as described herein above. In one embodiment, the gas turbine engine clearance control system directs cooling air through the compressor casing associated with a single compressor stage of the multi-stage compressor. In other embodiments, the gas turbine engine clearance control system directs cooling air through the compressor casing associated with at least two compressor stages of the multi-stage compressor. In some of these other embodiments, the gas turbine engine clearance control system may direct cooling air through the compressor casing associated with at least two compressor stages in series, characterized by cooling air entering the compressor case via a single opening formed in an external surface of the compressor casing and by cooling air leaving the compressor case via a single exit formed in the external surface of the compressor casing. In another portion of these other embodiments, the gas turbine engine clearance control system may direct cooling air through the compressor casing associated with at least two compressor stages in parallel, characterized by each portion of two or more portions of cooling air entering the compressor case via separate openings formed in the external surface of the compressor casing. Each opening directs cooling air to one compressor segment.

Parallel cooling of multiple stages of the compressor is further characterized by each portion of the cooling air exiting the compressor case via separate exits formed in the external surface of compressor. In yet other embodiments, multiple stages of a compressor are cooled using a combination of series and parallel cooling as described above. In various additional embodiments, the gas turbine engine clearance control system may be used to cool any number of compressor stages without limitation.

Exemplary embodiments of gas turbine engine clearance control systems are described above in detail. The gas turbine engine clearance control systems, and methods of operating such systems and devices are not limited to the specific embodiments described herein, but rather, components of systems and/or steps of the methods may be utilized independently and separately from other components and/or steps described herein. For example, the methods may also be used in combination with other systems requiring selective cooling, and are not limited to practice with only the systems and methods as described herein. Rather, the exemplary embodiment can be implemented and utilized in connection with many other machinery applications that are currently configured to receive and accept gas turbine engine clearance control systems.

Example methods and apparatus for selectively cooling a compressor casing of a gas turbine engine are described above in detail. The apparatus illustrated is not limited to the specific embodiments described herein, but rather, components of each may be utilized independently and separately from other components described herein. Each system component can also be used in combination with other system components.

This written description uses examples to describe the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A gas turbine engine clearance control system comprising:

a cooling air passage extending from a cooling air inlet port to a cooling air outlet port, said cooling air inlet port and outlet port formed within an external surface of a compressor casing of a compressor and axially spaced on said external surface, said cooling air passage extending from said cooling air inlet port radially inwardly to at least one of a flange joint, a radially outer surface of a compressor casing ring, and a radially outer surface of a connector case, said cooling air passage further extending aftward along said radially outer surfaces of said connector case and said compressor casing ring, said cooling air passage further extending radially outward to said cooling air outlet port, wherein selectively supplying cooling air to said cooling air passage controls a rotor tip clearance between a rotor tip of a rotor blade of said compressor and an inner surface of said compressor casing ring and further controls an interstage seal clearance between an inner band and a rotor spool of said compressor, wherein:

said rotor blade extends radially outwardly from an inner flow path surface of a rotor blade platform attached to said rotor spool towards an inner surface of said compressor casing ring and terminates at said rotor tip proximate said inner surface;

each of a plurality of stator vanes extends radially inwardly from a radially inner surface of an outer band and terminating at an inner band;

said outer band is configured to couple to said compressor casing ring radially with axial contact to said adjacent outer band; and said flange joint is configured to couple said compressor casing ring and said connector case, said compressor casing ring comprising a radially outwardly extending flange portion configured to be coupled to radially outwardly extending mounting flanges of said connector case axially adjacent to said flange portion.

2. The system of claim 1, wherein said cooling air passage further comprises a bifurcation upstream of said flange joint, said bifurcation comprising a first portion of said cooling air passage extending between respective faces of said flange portion and said mounting flanges and exiting through an aperture in one of said respective faces.

3. The system of claim 2, wherein said bifurcation further comprises a second portion of said cooling air passage extending aftward to an annulus of said compressor casing.

4. The system of claim 3, wherein said cooling air passage further comprises a baffle positioned between said bifurcation and said cooling air outlet port, said baffle configured to channel cooling air from said first portion and said second portion to said cooling air outlet port.

5. The system of claim 4, wherein said cooling air passage further comprises a manifold situated between said bifurcation and said baffle to rejoin said first portion and said second portion before entering said baffle.

6. The system of claim 1, further comprising a controller communicatively coupled to an air flow valve, said controller configured to:

select and open said air flow valve to permit said cooling air to flow through said cooling air passage to cool said compressor casing; and close said air flow valve to terminate cooling of said compressor casing.

7. The system of claim 6, further comprising a source of said cooling air coupled to said air flow valve, said source selectable from a fan assembly of said gas turbine engine, a booster compressor of said gas turbine engine, and an engine domestic bleed from a second compressor stage of said gas turbine engine, and wherein said air flow valve is selected from a first valve operatively coupled to said fan assembly, a second valve operatively coupled to said booster, and a third valve operatively coupled to said second compressor stage.

8. The system of claim 6, wherein said controller is configured to select and open said air flow valve during a first cruise operating condition of said gas turbine engine, said controller is configured to close said air flow valve during one of a plurality of second operating conditions of said gas turbine engine, the second operating conditions including a ground operating condition, a takeoff operating condition, a burst operating condition, and an error condition detected by said controller.

9. The system of claim 6, further comprising a plurality of air flow valves coupled in flow communication with respective air flow sources and wherein said controller is configured to select and open one of said plurality of air flow valves to permit air from a respective air flow source to flow through said cooling air passage to cool said compressor casing and to close said one of said plurality of air flow valves to terminate cooling of said compressor casing.

10. The system of claim 6, wherein said air flow valve is a modulating valve.

11. A method of selectively cooling a compressor of a gas turbine engine, said method comprising:

receiving a flow of cooling air from one of a plurality of selectable sources of cooling air;

channeling said flow of cooling air along a cooling air passage within a compressor casing of the compressor, said cooling air passage adjacent to at least one of a flange joint, a radially outer surface of a connector case, and a radially outer surface of a compressor casing ring;

directing the flow of cooling air radially inward toward the flange joint, the flange joint configured to couple a radially outwardly extending flange portion of the compressor casing ring and radially outwardly extending mounting flanges of the connector case axially adjacent to the flange portion;

bifurcating the flow of cooling air upstream of the flange joint into a first portion and a second portion;

directing the first portion between respective faces of the flange portion and the mounting flange of the flange joint and through an aperture in one of the respective faces;

directing the second portion aftward along the radially outer surfaces of the connector case and the compressor casing ring; and joining the first and second portions in an annulus adjacent the connector case and the compressor casing ring.

12. The method of claim 11, further comprising initiating the flow of cooling air by opening one of at least one valves, each of the at least one valves operatively coupled between one of the at least one sources and the cooling air passage.

13. The method of claim 11, wherein the at least one source is selected from fan cooling air from a fan assembly of the gas turbine engine, booster air from a booster of the gas turbine engine, and engine domestic bleed from a second compressor stage of the gas turbine engine, and any combination thereof.

14. The method of claim 12, further comprising:

selecting and opening the one valve using a controller according to a valve opening state comprising the gas turbine engine operating at a cruise condition; and closing the one valve to terminate cooling of the compressor casing using the controller according to a valve closing state selected from: the gas turbine engine operating at a ground condition, the gas turbine engine operating at a takeoff condition, the gas turbine engine operating at a ground condition, the gas turbine engine operating at a burst condition, the controller detecting an error condition, and any combination thereof.

15. A gas turbine engine clearance control system comprising a cooling air passage extending from a cooling air inlet port to a cooling air outlet port, said cooling air inlet port and outlet port formed within an external surface of a compressor casing of a compressor and axially spaced on said external surface, said cooling air passage extending from said cooling air inlet port radially inwardly to at least one of a flange joint, a radially outer surface of a compressor casing ring, and a radially outer surface of a connector case, said cooling air passage further extending aftward along said radially outer surfaces of said connector case and said compressor casing ring, said cooling air passage further extending radially outward to said cooling air outlet port, wherein selectively supplying cooling air to said cooling air passage controls a rotor tip clearance between a rotor tip of a rotor blade of said compressor and an inner surface of said compressor casing ring and further controls an interstage seal clearance between an inner band and a rotor spool of said compressor.

16. A method of selectively cooling a compressor of a gas turbine engine, said method comprising:

receiving a flow of cooling air from one of a plurality of selectable sources of cooling air;

channeling said flow of cooling air along a cooling air passage within a compressor casing of the compressor, said cooling air passage adjacent to at least one of a flange joint, a radially outer surface of a connector case, and a radially outer surface of a compressor casing ring;

splitting the flow of cooling air into a first and second portion using a bifurcation in the cooling air passage;

directing the first portion along a first flow path from an external surface of the compressor casing toward the connector case and the compressor casing ring in a first direction essentially perpendicular to the rotation axis; and directing the second portion along a second flow path along the radially outer surfaces of the connector case and the compressor casing ring.

17. The method of claim 16, further comprising directing the first and second portions of the flow of cooling air to an exit formed in the external surface of the compressor casing using a baffle operatively coupled to the cooling air passage between the bifurcation and the exit.

* * * * *